United States Patent [19]

Ackermann et al.

[11] Patent Number: 4,762,467

[45] Date of Patent: Aug. 9, 1988

[54] METHOD FOR CONTROLLING THE PRESSURE RATIO OF A JET PUMP

[75] Inventors: Hans Ackermann; Ralf Koecher, both of Duesseldorf; Udo Steinberner, Hilden; Otto Michel, Langenfeld, all of Fed. Rep. of Germany

[73] Assignee: Henkel Kommanditgesellschaft auf Aktien, Duesseldorf, Fed. Rep. of Germany

[21] Appl. No.: 944,630

[22] Filed: Dec. 19, 1986

[30] Foreign Application Priority Data

Dec. 21, 1985 [DE] Fed. Rep. of Germany ..... 3545612

[51] Int. Cl.[4] ..... F04F 5/52

[52] U.S. Cl. ..... 417/54; 417/69; 417/87; 417/185; 417/189

[58] Field of Search ..... 417/54, 69, 87, 183–185, 417/187–189

[56] References Cited

U.S. PATENT DOCUMENTS

| | | | |
|---|---|---|---|
| 2,140,306 | 12/1938 | Beals | 417/189 X |
| 3,456,871 | 7/1969 | Gösling | 417/189 |
| 4,332,527 | 6/1982 | Moldovan et al. | 417/87 X |

FOREIGN PATENT DOCUMENTS

| | | | |
|---|---|---|---|
| 1703040 | 12/1971 | Fed. Rep. of Germany | 417/54 |
| 87900 | 7/1980 | Japan | 417/87 |
| 79300 | 5/1982 | Japan | 417/189 |
| 35299 | 3/1983 | Japan | 417/188 |
| 81500 | 5/1985 | Japan | 417/54 |
| 98200 | 6/1985 | Japan | 417/188 |
| 934502 | 8/1963 | United Kingdom | 417/189 |

*Primary Examiner*—Leonard E. Smith
*Assistant Examiner*—Paul F. Neils
*Attorney, Agent, or Firm*—Ernest G. Szoke; Henry E. Millson, Jr.; Real J. Grandmaison

[57] ABSTRACT

In a jet pump, the suction pressure (Po) generated may be kept constant within predetermined limits and times by varying the pressure ratio f(p) providing a prescribed value for the pressure ratio f(p) is determined by computer-aided iterative changing of an existing value of the pressure ratio f(p) using an algorithm and a measured value for the pressure (Pe) of the delivery fluid.

8 Claims, 3 Drawing Sheets

METHOD FOR CONTROLLING THE PRESSURE RATIO OF A JET PUMP

BACKGROUND OF THE INVENTION

1. Field of the Invention

This invention relates to a method for controlling the pressure ratio of a jet pump for the purpose of regulating a predetermined operating or working vacuum.

2. Discussion of Related Art

In a jet pump, for example a steam jet pump, a gas jet pump or a water jet pump, the flow energy of a motive fluid through nozzles and diffusors is used to aspirate or compress a fluid to be delivered. Gases, vapors and liquids are used as the motive and delivery fluids. Jet pumps are easy to make and have no moving parts, but are relatively inefficient and become even more inefficient in the event of changes in the operating conditions, for example the pressures and delivery volumes. In view of the difficulties involved in the generally intermeshed or multiloop regulation of a jet pump, jet pumps are operated at constant motive fluid pressure in practice, the surplus energy being destroyed by throttling, addition of a foreign gas, or by acceptance of a lower reduced pressure or suction pressure than that required.

Jet pumps, preferably steam jet pumps, are used for example as suction pressure generators in vacuum distillation. With plants as complicated as these, a prescribed behavior profile is intended to be achieved simultaneously for a number of controlled variables. However, these variables are interdependent. In addition, every regulating intervention influences the other controlled variables, in general to a more or less considerable extent. Accordingly, it is only possible to use intermeshed rather than separate controllers. The problems of autonomy, invariance, controllability and observability involved in multiple control systems of this type makes the use of conventional P, I, PI and PID control techniques and the like hypothetical at least on economic grounds.

In a jet pump of given dimensions, the ratio of motive fluid volume G1 to delivery fluid volume G2 is a function of Pe=motive fluid pressure, Pa=pressure at exit of jet pump, and Po=suction pressure.

Accordingly, for a predetermined suction pressure Po and a predetermined volume of delivery fluid G2, the necessary volume of motive fluid G1 is only dependent on a function of Pe and Pa. Since this function has the form of a pressure ratio, the expression "controlling the pressure ratio" in the context of the method according to the invention means the control of Pe and/or Pa.

DESCRIPTION OF THE INVENTION

An object of the invention is to provide a method by which the suction pressure generated in the delivery fluid of a jet pump may be kept constant by variation of the motive fluid pressure and hence the motive fluid volume within predetermined limits and times and in which the consumption of energy may be kept at an optimally low level. According to the invention, this object is achieved in that a specified value for the pressure ratio is determined from the continuously measured value of the operating vacuum by computer-aided iterative stepwise changing of an existing value of the pressure ratio.

By reason of the fact that, according to the invention, the actual value of the operating vacuum is measured, processed by the computer-aided iterative change to an output quantity and used in that form as a manipulated variable for the motive fluid pressure, i.e. for the volume of motive fluid fed to the jet pump per unit of time, the motive fluid pressure can always be optimally adapted to meet the requirements on the vacuum side. In this way, it is possible, for example in a vacuum distillation or vacuum evaporation plant, to obtain an energy saving of up to 50% over the conventional procedure.

According to another aspect of the invention, the specified value for the pressure ratio determined by calculation may be fed in the form of a manipulated variable for the motive fluid pressure to a regulating valve in the pipe for the motive fluid, or it may be used as a command variable for the motive fluid pressure and/or output pressure in associated automatic control systems.

The iterative change is preferably effected by use of an algorithm in conjunction with a computer. The prescribed value may optionally be determined by indefinitely repeating the algorithm with the computer at its own speed.

This means that, in the event of changes in its input quantity, namely the measured value of the suction pressure, the output quantity, namely the manipulated variable for the motive fluid pressure, has to be changed until the value of the input quantity is back within the predetermined limits. Accordingly, the output quantity of the computer is not a value which bears a fixed functional relationship with the input quantity, instead it is obtained by the iterative increase or decrease of the particular output quantity previously present.

In addition, it is preferred if, after each stepwise change in the desired value, a waiting time corresponding to the dead time of the system is observed. Finally the speed with which the prescribed value is changed should be adapted to the magnitude and rate of change of the desired value/actual value deviation of the operating vacuum within preselectable limits. An algorithm with different processing branches for different ranges of the prescribed value/actual value deviation of the operating vacuum and its rate of change is preferably used for this purpose. In this way, it is possible to adapt the rate of change of the output quantity to that of the input quantity within preselectable limits.

BRIEF DESCRIPTION OF THE DRAWINGS

Details of the invention are described in the following with reference to the accompanying diagrammatic drawings, wherein.

DETAILED DESCRIPTION OF THE DRAWINGS

Figure 1:
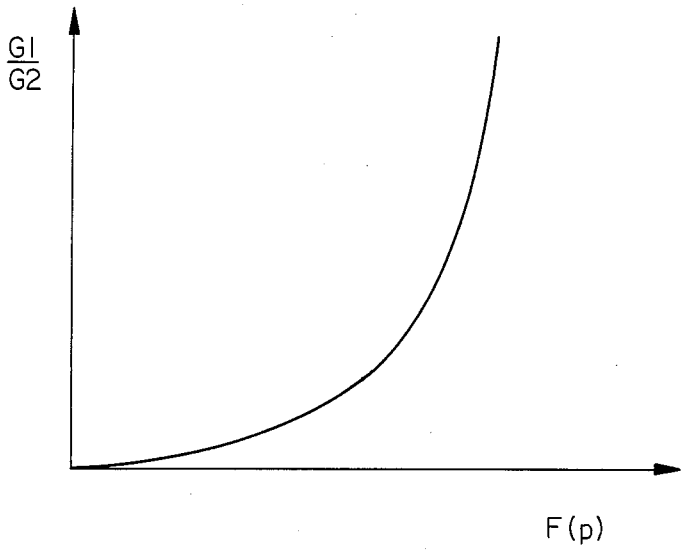
FIG. 1 is a graph showing the dependence of the quantitative ratio between motive fluid and delivery fluid upon the motive fluid pressure, exit pressure and suction pressure of a jet pump.

In FIG. 1, the ratio G1/G2 between the volume G1 of motive fluid and the volume G2 of delivery fluid is recorded on the ordinate and the pressure ratio f(p) on the abscissa. The pressure ratio is a function of the motive fluid pressure Pe, the pressure Pa at the exit of the jet pump and the suction pressure Po. For a liquid-operated jet pump, the pressure ratio is defined as follows:

$$f_L(p) = \frac{Pa - Po}{Pe - Po}$$

By contrast, for a gas-operated jet pump, the pressure ratio is defined as follows:

$$f_G(p) = \frac{\frac{Pa}{Po}^{\frac{\varphi - 1}{\varphi}} - 1}{1 - \frac{Po}{Pe}^{\frac{\varphi - 1}{\varphi}}}$$

where $\varphi$ is the adiabatic component of the gas. In the case of steam, the pressure gradient is replaced by the corresponding enthalpy gradient (h,s-graph) analogously to the function $f_L(p)$.

Figure 2:
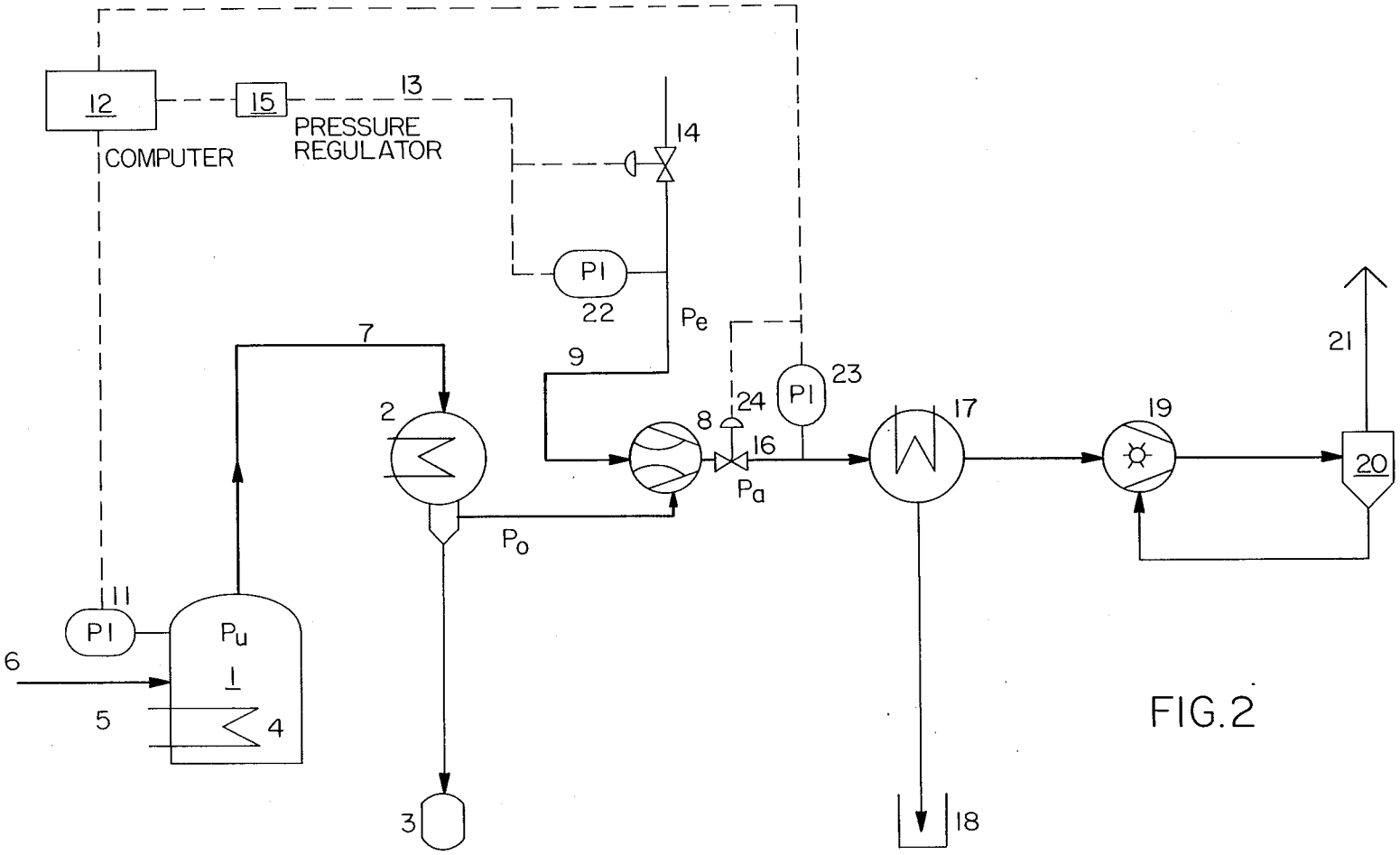
FIG. 2 illustrates an arrangement for generating vacuum in a vacuum distillation process.

In the embodiment illustrated in FIG. 2, the vacuum container 1 of a distillation column, which may be equipped with a condenser 2, a distillate receiver 3, a liquid sump 4, a heating system 5 and a liquid feed pipe 6, is connected to a steam jet pump 8 by a feed pipe 7 for delivery fluid. The designation Pu generally indicates the container as being a reduced pressure distillation apparatus. In the jet pump 8, the reduced pressure is generated by forcing a motive fluid coming from a motive fluid pipe 9 at high speed through a nozzle with the result that the pressure at the nozzle exit is greatly reduced and the delivery fluid waiting there is sucked in. In this way, gas in the container 1 is withdrawn under suction and a suction pressure Po established in the container. The suction pressure should not exceed a certain maximum value on account of the dependence on pressure of the boiling point of the liquid 4 in the container 1. However, certain minimum values should or may also be observed. Accordingly, the actual value of the suction pressure Po generated in the container 1 is measured by means of a vacuum gauge 11 and delivered as input quantity to a computer 12 with algorithm. In the computer 12, the input quantity of the suction pressure Pn is processed by the algorithm to an output quantity which in turn serves as the prescribed value or manipulated variable for the motive fluid pressure Pe of the jet pump 8.

In the embodiment illustrated, the manipulated variable is applied through a direct line 13 to a control or regulating valve 14 in the motive fluid pipe 9. Alternatively, the prescribed value of the motive fluid pressure determined in the computer 12 may also be fed to an intermediate pressure regulator 15 for the motive fluid pressure. The active lines of the pressure regulator 15 which may be necessary for this purpose are shown in broken lines in the drawing. Motive fluid pipe 9 may also be provided with a pressure gauge 22. The information direction is indicated by arrows. In the case of steam, the exit 16 of the jet pump leads into corresponding condensate systems which may optionally be pre-evacuated. For example, the exit 16 of the jet pump may be fed to a condenser 17 for the motive steam adapted with a barometric immersion vessel 18, or fed to a water ring pump 19 then to a water separator 20 wherefrom it may alternatively be fed to an atmospheric exit 21 or recirculated to water ring pump 19.

Figure 3:
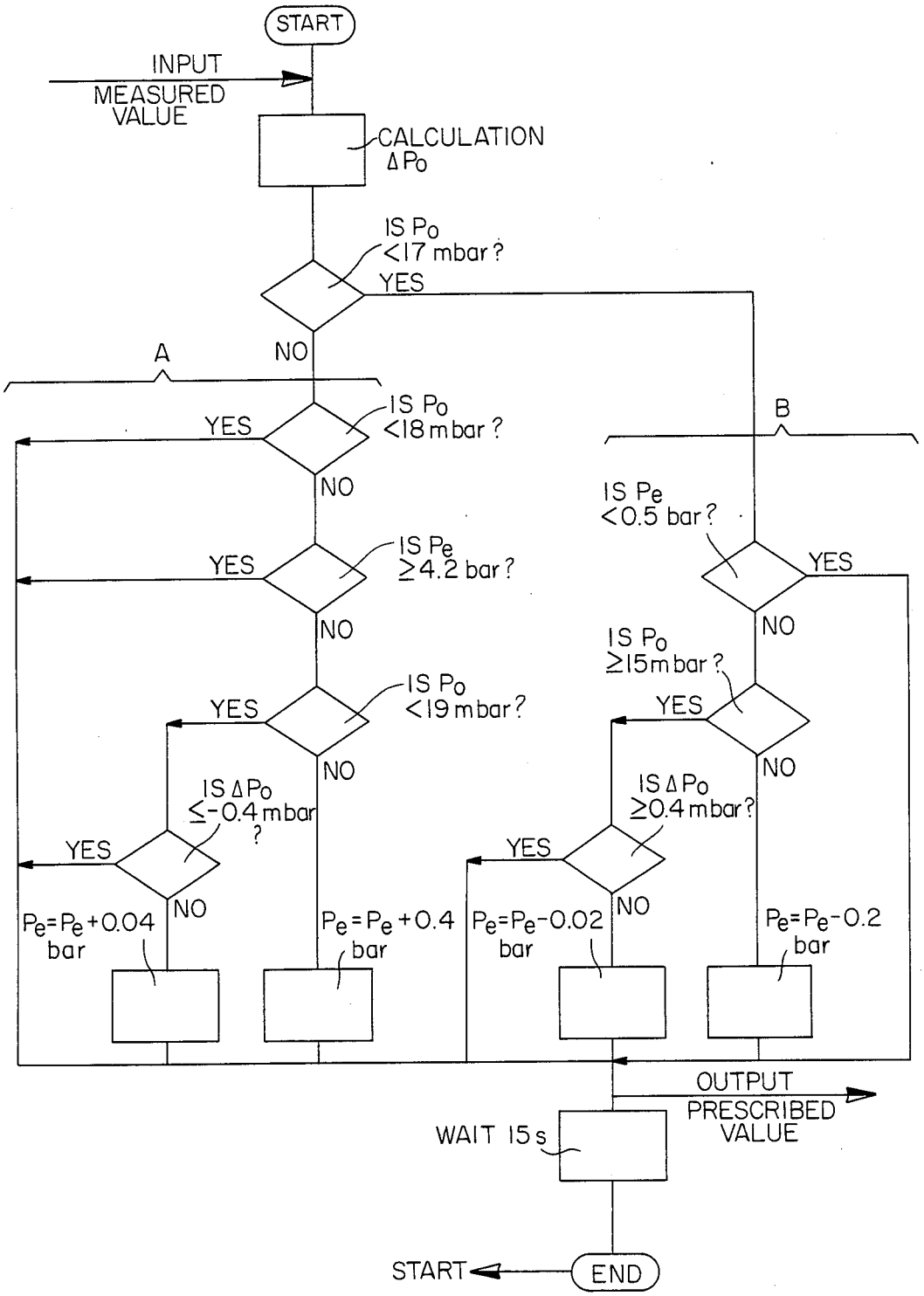
FIG. 3 illustrates the flowsheet of an algorithm for the iterative determination of a manipulated variable.

FIG. 3 shows one embodiment of a flowsheet of the algorithm to be used in the computer 12. Concrete values are cited for all parameters to make the algorithm easier to understand. However, these values are to be regarded solely as examples. In the drawing, Po represents the suction pressure in the container 1 as measured by the gauge 11, Pe represents the motive fluid pressure applied via the motive fluid pipe 9 to the jet pump 8 and ΔPo the difference compared with the preceding measured value of the reduced suction pressure Po.

At the start of the algorithm, the particular measured value of the suction pressure Po generated, i.e. the input quantity determined by the vacuum gauge 11, is fed into the computer 12. The algorithm shown as an example has two main processing branches A and B which have to be selected according to the rate of change and the prescribed value/actual value deviation of the computer input quantity. Through the choice and configuration of the branches A, B, it is possible to adapt the rate of change of the output quantity within preselectable limits to that of the input quantity. In both cases, the output quantity Pe of the computer 12 is obtained by iterative increase or reduction of the particular output quantity Pe present and, through a predetermined waiting time, also take into account the dead time of the system attributable to the plant.

After determination of the output quantity of the computer 12, the algorithm is indefinitely repeated at its own speed. In FIG. 3, this endless loop is symbolized by the start sign at the bottom of the flowsheet.

We claim:

1. A method for controlling the pressure ratio of a jet pump to regulate a predetermined operating vacuum, said pressure ratio being defined as for a predetermined suction pressure and a predetermined volume of delivery fluid, the necessary volume of motive fluid is dependent on a function of the motive fluid pressure and the pressure at the exit of said jet pump, wherein a desired value for said pressure ratio is determined from the continuously measured value of the operating vacuum determined from the suction pressure in a vacuum container by a computer-aided iterative stepwise changing of an existing value of said pressure ratio, said iterative stepwise changing of an existing value of said pressure ratio being effected by use of an algorithm wherein the desired value is obtained by indefinitely repeating the algorithm using a corresponding computer, adapting the rate of change of the desired value for said pressure ratio to the magnitude and rate of change of the desired value/actual value deviation of the operating vacuum within preselectable limits, said algorithm having difference processing branches for different ranges of said desired value/actual value deviation of said operating vacuum and its rate of change, and observing a waiting time corresponding to the dead time of the system after each stepwise change of the desired value for said pressure ratio.

2. A method as in claim 1, wherein the desired value for said pressure ratio is fed in the form of a manipulated variable for the motive fluid pressure to a regulating valve in the pipe for the motive fluid.

3. A method as in claim 1, wherein the desired value for said pressure ratio is used as a command quantity for the motive fluid pressure and/or the output pressure in an associated automatic control system.

4. A method for controlling the pressure ratio of a jet pump to regulate a predetermined operating vacuum; said pressure ratio being a function of the motive fluid pressure, the pressure at the exit of said jet pump and the suction pressure in a vacuum container; wherein a desired value for said pressure ratio is determined from the continuously measured value of said suction pressure by computer-aided iterative stepwise changing of an existing value of said pressure ratio, effecting said iterative stepwise changing of an existing value of said pressure ratio by the use of an algorithm wherein the desired value is obtained by indefinitely repeating the algorithm using a corresponding computer, adapting the rate of change of the desired value for said pressure ratio to the magnitude and rate of change of the desired value/actual value deviation of the operating vacuum within preselectable limits, said algorithm having different processing branches for different ranges of said desired value/actual value deviation of said operating vacuum and its rate of change, and observing a waiting time corresponding to the dead time of the system after each stepwise change of the desired value for said pressure ratio.

5. A method as in claim 4 wherein said actual value of said operating vacuum is measured, processed by a computer-aided algorithm to an output quantity, and used in that form as a manipulated variable for said motive fluid pressure.

6. A method as in claim 5 wherein said motive fluid pressure represents the volume of motive fluid fed to said jet pump per unit of time.

7. A method as in claim 5 wherein said desired value for said pressure ratio is fed in the form of a manipulated variable for said motive fluid pressure to a regulating valve in the pipe for said motive fluid.

8. A method as in claim 5 wherein said desired value for said pressure ratio is fed in the form of a command variable for said motive fluid pressure and/or output pressure to an associated automatic control system.

* * * * *